US011538422B2

(12) United States Patent
Lee et al.

(10) Patent No.: US 11,538,422 B2
(45) Date of Patent: Dec. 27, 2022

(54) PIXEL OF LIGHT EMITTING DISPLAY DEVICE, AND LIGHT EMITTING DISPLAY DEVICE

(71) Applicant: Samsung Display Co., LTD., Yongin-si (KR)

(72) Inventors: Wonjun Lee, Hwaseong-si (KR); Mihyeon Jo, Seoul (KR); Cholho Kim, Suwon-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/463,518

(22) Filed: Aug. 31, 2021

(65) Prior Publication Data

US 2022/0284865 A1 Sep. 8, 2022

(30) Foreign Application Priority Data

Mar. 8, 2021 (KR) ..... 10-2021-0030307

(51) Int. Cl.
*G09G 3/3291* (2016.01)
*G09G 3/3266* (2016.01)
*G09G 3/3233* (2016.01)

(52) U.S. Cl.
CPC ..... *G09G 3/3291* (2013.01); *G09G 3/3233* (2013.01); *G09G 3/3266* (2013.01); *G09G 2300/043* (2013.01)

(58) Field of Classification Search
CPC .. G09G 3/3291; G09G 3/3233; G09G 3/3266; G09G 2300/043
See application file for complete search history.

(56) References Cited

U.S. PATENT DOCUMENTS

2014/0111490 A1* 4/2014 Lee ..... G11C 19/28 345/204
2015/0049126 A1* 2/2015 Jung ..... G09G 3/3233 315/172
2018/0218678 A1* 8/2018 Kwon ..... G09G 3/3233

FOREIGN PATENT DOCUMENTS

KR 101030003 B1 4/2011
KR 1020180056442 A 5/2018
KR 1020200034086 A 3/2020
KR 1020200093745 A 8/2020
KR 1020200097856 A 8/2020
KR 102167102 B1 10/2020

* cited by examiner

*Primary Examiner* — Stacy Khoo
(74) *Attorney, Agent, or Firm* — Cantor Colburn LLP

(57) ABSTRACT

A pixel of a light emitting display device includes: a switching transistor which transfers a data voltage in response to a gate writing signal, a storage capacitor which stores a storage voltage, a driving transistor which generates a driving current based on the storage voltage stored in the storage capacitor, an emission transistor which selectively forms a path of the driving current in response to an emission signal, a light emitting diode which emits light based on the driving current, and a diode initialization transistor which transfers an initialization voltage to the light emitting diode in response to the emission signal. The storage voltage corresponds to a value obtained by subtracting a threshold voltage of the driving transistor from the data voltage.

20 Claims, 13 Drawing Sheets

PIXEL OF LIGHT EMITTING DISPLAY DEVICE, AND LIGHT EMITTING DISPLAY DEVICE

This application claims priority to Korean Patent Application No. 10-2021-0030307, filed on Mar. 8, 2021, and all the benefits accruing therefrom under 35 U.S.C. § 119, the content of which in its entirety is herein incorporated by reference.

BACKGROUND

1. Field

Embodiments of the present inventive concept relate to a display device, and more particularly to a pixel of a light emitting display device, and the light emitting display device.

2. Description of the Related Art

A light emitting display device, such as an organic light emitting diode ("OLED") display device, may generally display an image at a fixed driving frequency (or a constant refresh rate) of about 60 Hertz (Hz), about 120 Hz or more. A variable refresh rate ("VRR") technique has been developed which changes a driving frequency according to a characteristic of an image or according to an image source (e.g., an application that generates image data).

However, in the OLED display device to which the VRR technique is applied, a luminance of a display panel driven at a first driving frequency and a luminance of the display panel driven at a second driving frequency different from the first driving frequency may be different from each other. Accordingly, when the driving frequency of the display panel is changed, a flicker may occur. In particular, in a case where the OLED display device performs an active-matrix organic light emitting diode ("AMOLED") off ratio ("AOR") driving operation that allows each pixel to periodically emit (and not emit) within one frame period in order to adjust a ratio (e.g., AOR) of a non-emission period to the one frame period, the luminance difference between different driving frequencies may be intensified.

SUMMARY

Some embodiments provide a pixel of a light emitting display device having a substantially constant luminance at different driving frequencies.

Some embodiments provide a light emitting display device including a pixel having a substantially constant luminance at different driving frequencies.

According to embodiments, there is provided a pixel of a light emitting display device including: a switching transistor which transfers a data voltage in response to a gate writing signal, a storage capacitor which stores a storage voltage, a driving transistor which generates a driving current based on the data voltage stored in the storage capacitor, an emission transistor which selectively forms a path of the driving current in response to an emission signal, a light emitting diode which emits light based on the driving current, and a diode initialization transistor which transfers an initialization voltage to the light emitting diode in response to the emission signal. The storage voltage corresponds to a value obtained by subtracting a threshold voltage of the driving transistor from the data voltage.

In embodiments, the emission transistor may be turned on in response to the emission signal when the emission signal has a first level, and the diode initialization transistor may be turned on in response to the emission signal when the emission signal has a second level different from the first level.

In embodiments, a frame period may include a plurality of non-emission periods, and a plurality of emission periods between the plurality of non-emission periods, and the diode initialization transistor may be turned on for an entire period of the plurality of non-emission periods.

In embodiments, the emission transistor may be implemented with a first conductive type transistor, and the diode initialization transistor may be implemented with a second conductive type transistor which is different from the first conductive type transistor.

In embodiments, the emission transistor may be implemented with a p-type metal-oxide-semiconductor ("PMOS") transistor, and wherein the diode initialization transistor may be implemented with an n-type metal-oxide-semiconductor ("NMOS") transistor.

In embodiments, the diode initialization transistor may include a gate which receives the emission signal, a first terminal coupled to the light emitting diode, and a second terminal which receives the initialization voltage.

In embodiments, the storage capacitor may include: a first electrode coupled to a line which supplies a first power supply voltage, and a second electrode coupled to a gate node, the driving transistor may include a first transistor including a gate coupled to the gate node, a first terminal, and a second terminal. The switching transistor may include: a second transistor including a gate which receives the gate writing signal, a first terminal which receives the data voltage, and a second terminal coupled to the first terminal of the first transistor. The emission transistor may include: a fifth transistor including a gate which receives the emission signal, a first terminal coupled to the line which supplies the first power supply voltage, and a second terminal coupled to the first terminal of the first transistor, and a sixth transistor including a gate which receives the emission signal, a first terminal coupled to the second terminal of the first transistor, and a second terminal coupled to the light emitting diode. The light emitting diode may include an anode coupled to the second terminal of the sixth transistor, and a cathode coupled to a line which supplies a second power supply voltage.

In embodiments, the pixel may further include a compensation transistor which diode-connects the driving transistor in response to the gate writing signal, and a gate initialization transistor which transfers the initialization voltage to the gate node in response to a gate initialization signal.

In embodiments, the compensation transistor may include: a third transistor including a gate receiving the gate writing signal, a first terminal coupled to the second terminal of the first transistor, and a second terminal coupled to the gate node. The gate initialization transistor may include a fourth transistor including a gate receiving the gate initialization signal, a first terminal coupled to the gate node, and a second terminal which receives the initialization voltage.

According to embodiments, there is provided a pixel of a light emitting display device including: a capacitor including a first electrode coupled to a line which supplies a first power supply voltage, and a second electrode coupled to a gate node; a first transistor including a gate coupled to the gate node, a first terminal, and a second terminal; a second transistor including a gate which receives a gate writing signal, a first terminal which receives a data voltage, and a second terminal coupled to the first terminal of the first transistor; a third transistor including a gate which receives the gate writing signal, a first terminal coupled to the second terminal of the first transistor, and a second terminal coupled to the gate node; a fourth transistor including a gate which receives a gate initialization signal, a first terminal coupled to the gate node, and a second terminal which receives an initialization voltage; a fifth transistor including a gate which receives an emission signal, a first terminal coupled to the line which supplies the first power supply voltage, and a second terminal coupled to the first terminal of the first transistor; a sixth transistor including a gate which receives the emission signal, a first terminal coupled to the second terminal of the first transistor, and a second terminal coupled to a light emitting diode; a seventh transistor including a gate which receives the emission signal, a first terminal coupled to the light emitting diode, and a second terminal which receives the initialization voltage; and the light emitting diode including an anode coupled to the second terminal of the sixth transistor, and a cathode coupled to a line which supplies a second power supply voltage.

In embodiments, the fifth and sixth transistors may be turned on in response to the emission signal when the emission signal has a first level, and the seventh transistor may be turned on in response to the emission signal when the emission signal has a second level different from the first level.

In embodiments, the fifth and sixth transistors may be implemented with first conductive type transistors, and the seventh transistor may be implemented with a second conductive type transistor different from the first conductive type transistors.

In embodiments, the first, second, third, fourth, fifth and sixth transistors may be implemented with p-type metal-oxide-semiconductor (PMOS) transistors, and the seventh transistor may be implemented with an n-type metal-oxide-semiconductor (NMOS) transistor.

In embodiments, the first, second, fifth and sixth transistors may be implemented with PMOS transistors, and the third, fourth and seventh transistors may be implemented with NMOS transistors.

In embodiments, the second, fifth and sixth transistors may be implemented with PMOS transistors, and the first, third, fourth and seventh transistors may be implemented with NMOS transistors.

According to embodiments, there is provided a light emitting display device including: a display panel including a plurality of pixels, a data driver which provides a data voltage to each of the plurality of pixels, a scan driver which provides a gate writing signal and a gate initialization signal to each of the plurality of pixels, and an emission driver which provides an emission signal to each of the plurality of pixels. Each of the plurality of pixels includes: a switching transistor which transfers the data voltage in response to the gate writing signal, a storage capacitor which stores a storage voltage, a driving transistor which generates a driving current based on the storage voltage stored in the storage capacitor, an emission transistor which selectively forms a path of the driving current in response to the emission signal, a light emitting diode which emits light based on the driving current, and a diode initialization transistor which transfers an initialization voltage to the light emitting diode in response to the emission signal. The storage voltage corresponds to a value obtained by subtracting a threshold voltage of the driving transistor from the data voltage.

In embodiments, the emission driver may generate the emission signal which periodically alternates between a first level and a second level in a frame period, the first level may be different from the second level, the emission transistor may be turned on in response to the emission signal when the emission signal has the first level, and the diode initialization transistor may be turned on in response to the emission signal when the emission signal has the second level.

In embodiments, a frame period may include a plurality of non-emission periods, and a plurality of emission periods between the plurality of non-emission periods, and the diode initialization transistor may be turned on for an entire period of the plurality of non-emission periods.

In embodiments, the emission transistor may be implemented with a first conductive type transistor, and the diode initialization transistor may be implemented with a second conductive type transistor different from first conductive type transistor.

In embodiments, the emission transistor may be implemented with a p-type metal-oxide-semiconductor (PMOS) transistor, and the diode initialization transistor may be implemented with an n-type metal-oxide-semiconductor (NMOS) transistor.

As described above, in a pixel of a light emitting display device and the light emitting display device according to embodiments, the pixel may include a switching transistor, a storage capacitor, a driving transistor, an emission transistor, a light emitting diode and a diode initialization transistor, and the diode initialization transistor may transfer an initialization voltage to the light emitting diode in response to an emission signal applied to the emission transistor. Thus, the diode initialization transistor may be turned on to perform a diode initialization operation for an entire period of a plurality of non-emission periods included in one frame period. Accordingly, the pixel may have a substantially constant luminance at different driving frequencies, and may prevent an undesired emission of the pixel in an initial period of each non-emission period.

BRIEF DESCRIPTION OF THE DRAWINGS

Illustrative, non-limiting embodiments will be more clearly understood from the following detailed description in conjunction with the accompanying drawings.

DETAILED DESCRIPTION

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. Hereinafter, embodiments of the present inventive concept will be explained in detail with reference to the accompanying drawings.

Figure 1:
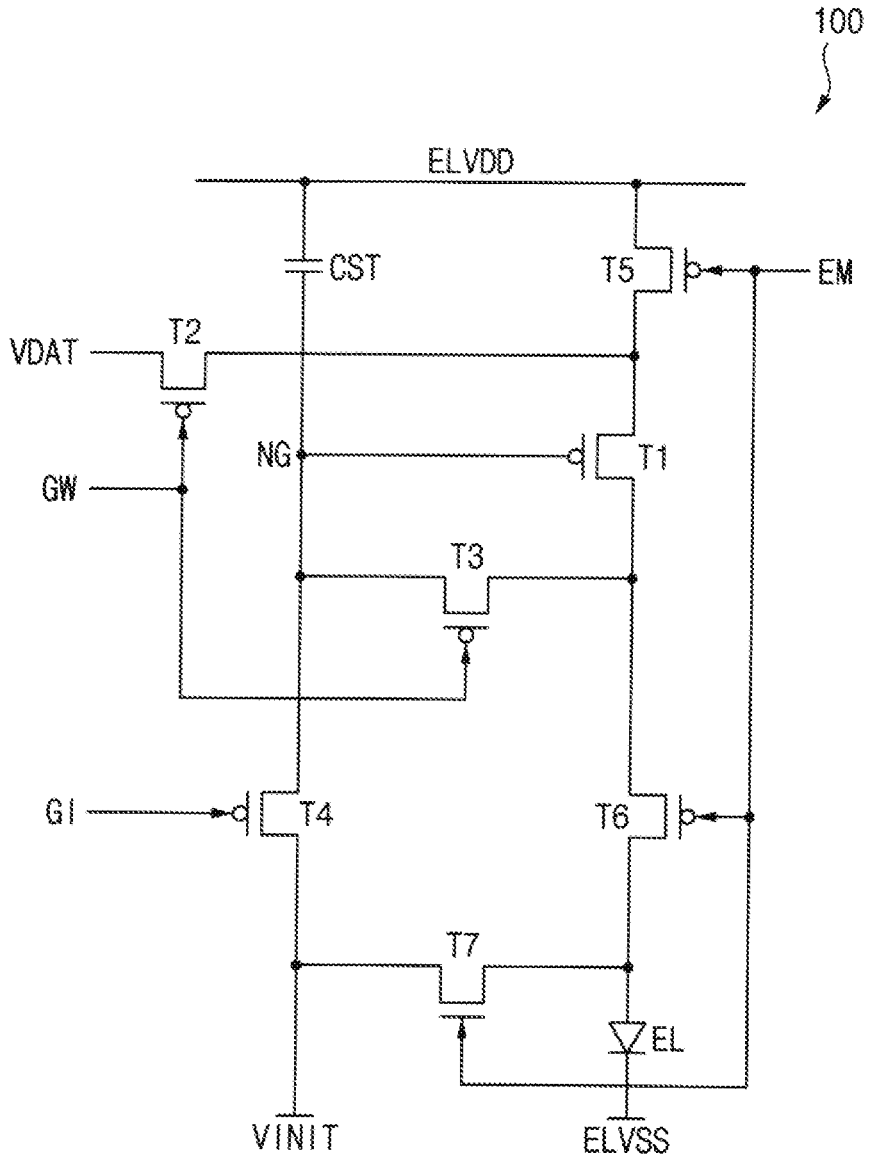
FIG. 1 is a circuit diagram illustrating a pixel of a light emitting display device according to embodiments.

FIG. 1 is a circuit diagram illustrating a pixel of a light emitting display device according to embodiments.

Referring to FIG. 1, a pixel 100 of a light emitting display device (e.g., an organic light emitting diode ("OLED") display device) according to embodiments may include a switching transistor T2, a storage capacitor CST, a driving transistor T1, an emission transistor T5 and T6, a light emitting diode EL (e.g., an OLED) and a diode initialization transistor T7. In some embodiments, the pixel 100 may further include a compensation transistor T3 and a gate initialization transistor T4.

The storage capacitor CST may store a data voltage VDAT transferred by the switching transistor T2. In some embodiments, the storage capacitor CST may store the data voltage transferred through the switching transistor T2 and the driving transistor T1 that is diode-connected by the compensation transistor T3. Thus, the storage capacitor CST may store a storage voltage VDAT-VTH where a threshold voltage VTH of the driving transistor T1 is compensated (or subtracted) from the data voltage VDAT (See FIG. 4). In some embodiments, the storage capacitor CST may include a first electrode coupled to a line for supplying a first power supply voltage ELVDD (e.g., a high-power supply voltage), and a second electrode coupled to a gate node NG.

The driving transistor T1 may generate a driving current based on the storage voltage VDAT-VTH (e.g., the storage voltage VDAT-VTH has a value that the threshold voltage VTH of the driving transistor T1 is compensated from the data voltage VDAT) stored in the storage capacitor CST. In some embodiments, the driving transistor T1 may include a first transistor T1 including a gate coupled to the gate node NG, a first terminal coupled to second and fifth transistors T2 and T5, and a second terminal coupled to a sixth transistor T6.

The switching transistor T2 may transfer the data voltage VDAT in response to a gate writing signal GW. In some embodiments, the second transistor T2 may transfer the data voltage VDAT to the storage capacitor CST through the driving transistor T1 that is diode-connected by the compensation transistor T3. In some embodiments, the switching transistor T2 may include the second transistor T2 including a gate receiving the gate writing signal GW, a first terminal receiving the data voltage VDAT, and a second terminal coupled to the first terminal of the first transistor T1.

The compensation transistor T3 may diode-connect the first transistor T1 in response to the gate writing signal GW. Thus, while the gate writing signal GW is applied, the data voltage VDAT may be transferred to the storage capacitor CST through the switching transistor T2 and the diode-connected driving transistor T1. The compensation transistor T3 may include a third transistor T3 including a gate receiving the gate writing signal GW, a first terminal coupled to the second terminal of the first transistor T1, and a second terminal coupled to the gate node NG.

The gate initialization transistor T4 may transfer an initialization voltage VINIT to the gate node NG in response to a gate initialization signal GI. Thus, while the gate initialization signal GI is applied, the gate initialization transistor T4 may initialize the gate node NG. In some embodiments, the gate initialization transistor T4 may include a fourth transistor T4 including a gate receiving the gate initialization signal GI, a first terminal coupled to the gate node NG, and a second terminal receiving the initialization voltage VINIT.

The emission transistor T5 and T6 may selectively form a path of the driving current in response to an emission signal EM. For example, the emission transistor T5 and T6 may be turned on to form the path of the driving current while the emission signal EM has a first level (e.g., a low level), and may be turned off not to form the path of the driving current while the emission signal EM has a second level (e.g., a high level). In some embodiments, the emission transistor T5 and T6 may include the fifth transistor T5 including a gate receiving the emission signal EM, a first terminal coupled to the line for supplying the first power supply voltage ELVDD, and a second terminal coupled to the first terminal of the first transistor T1, and the sixth transistor T6 including a gate receiving the emission signal EM, a first terminal coupled to the second terminal of the first transistor T1, and a second terminal coupled to the light emitting diode EL.

The light emitting diode EL may emit light based on the driving current generated by the first transistor T1. In some embodiments, the light emitting diode EL may be, but not limited to, an organic light emitting diode. In some embodiments, the light emitting diode EL may include an anode coupled to the second terminal of the sixth transistor T6, and a cathode coupled to a line for supplying a second power supply voltage ELVSS (e.g., a low power supply voltage).

The diode initialization transistor T7 may transfer the initialization voltage VINIT to the light emitting diode EL in response to the emission signal EM. For example, the diode initialization transistor T7 may be turned off while the emission signal EM has the first level (e.g., the low level), and may be turned on while the emission signal EM has the second level (e.g., the high level). In some embodiments, the diode initialization transistor T7 may include a seventh transistor T7 including a gate receiving the emission signal EM, a first terminal coupled to the light emitting diode EL, and a second terminal receiving the initialization voltage VINIT.

In some embodiments, as illustrated in FIG. 1, the driving transistor T1, the switching transistor T2, the compensation transistor T3, the gate initialization transistor T4 and the emission transistor T5 and T6 may be implemented with first conductive type (e.g., a p-type) transistors, and the diode initialization transistor T7 may be implemented with a second conductive type (e.g., an n-type) transistor. For example, the driving transistor T1, the switching transistor T2, the compensation transistor T3, the gate initialization transistor T4 and the emission transistor T5 and T6 may be implemented with p-type (or p-channel) metal-oxide-semiconductor ("PMOS") transistors, and the diode initialization transistor T7 may be implemented with an n-type (or n-channel) metal-oxide-semiconductor ("NMOS") transistor. In this case, since the emission transistor T5 and T6 is implemented with the first conductive type (e.g., the p-type) transistors, and the diode initialization transistor T7 is implemented with the second conductive type (e.g., the n-type) transistor, the emission transistor T5 and T6 may be turned on in response to the emission signal EM having the first level (e.g., the low level), and the diode initialization transistor T7 may be turned on in response to the emission signal EM having the second level (e.g., the high level).

In a pixel of a conventional light emitting display device, a diode initialization transistor may be turned on in response to a gate writing signal (or a gate bypass signal). Further, the gate writing signal may be activated in an initial period of a frame period, and thus the diode initialization transistor may be turned on to initialize a light emitting diode only in the initial period of the frame period. Thus, during substantially the same time, the number of times of initialization of the light emitting diode of the pixel driven at a first driving frequency may be different from the number of times of initialization of the light emitting diode of the pixel driven at a second driving frequency different from the first driving frequency. Accordingly, luminance of the pixel driven at different driving frequencies may be different from each other. In particular, in a case where the conventional light emitting display device performs an active-matrix organic light emitting diode ("AMOLED") off ratio ("AOR") driving operation that allows each pixel to periodically emit (and not emit) within one frame period in order to adjust a ratio (e.g., AOR) of a non-emission period to the one frame period, the luminance difference between different driving frequencies may be intensified (i.e., increased).

However, in the pixel 100 according to embodiments, the diode initialization transistor T7 may be turned on in response to the emission signal EM having the second level (e.g., the high level). Further, in some embodiments, in the pixel 100 on which the AOR driving operation is performed, one frame period may include a plurality of non-emission periods, and a plurality of emission periods between the plurality of non-emission periods, and the diode initialization transistor T7 may be turned on for an entire period of the plurality of non-emission periods. Thus, during a predetermined period (e.g., one frame period FP), the number of times of initialization of the light emitting diode EL of the pixel 100 driven at a first driving frequency may be substantially the same as the number of times of initialization of the light emitting diode EL of the pixel 100 driven at a second driving frequency different from the first driving frequency. Accordingly, the pixel 100 according to embodiments may have a substantially uniform (or constant) luminance at different driving frequencies. Further, in the pixel 100 according to embodiments, since an initialization operation for the light emitting diode EL is performed for the entire period of the plurality of non-emission periods, an undesired emission of the pixel 100 in an initial period of each non-emission period may be effectively prevented.

Hereinafter, an example of an operation of the pixel 100 according to embodiments will be described below with reference to FIGS. 1 through 8.

Figure 2:
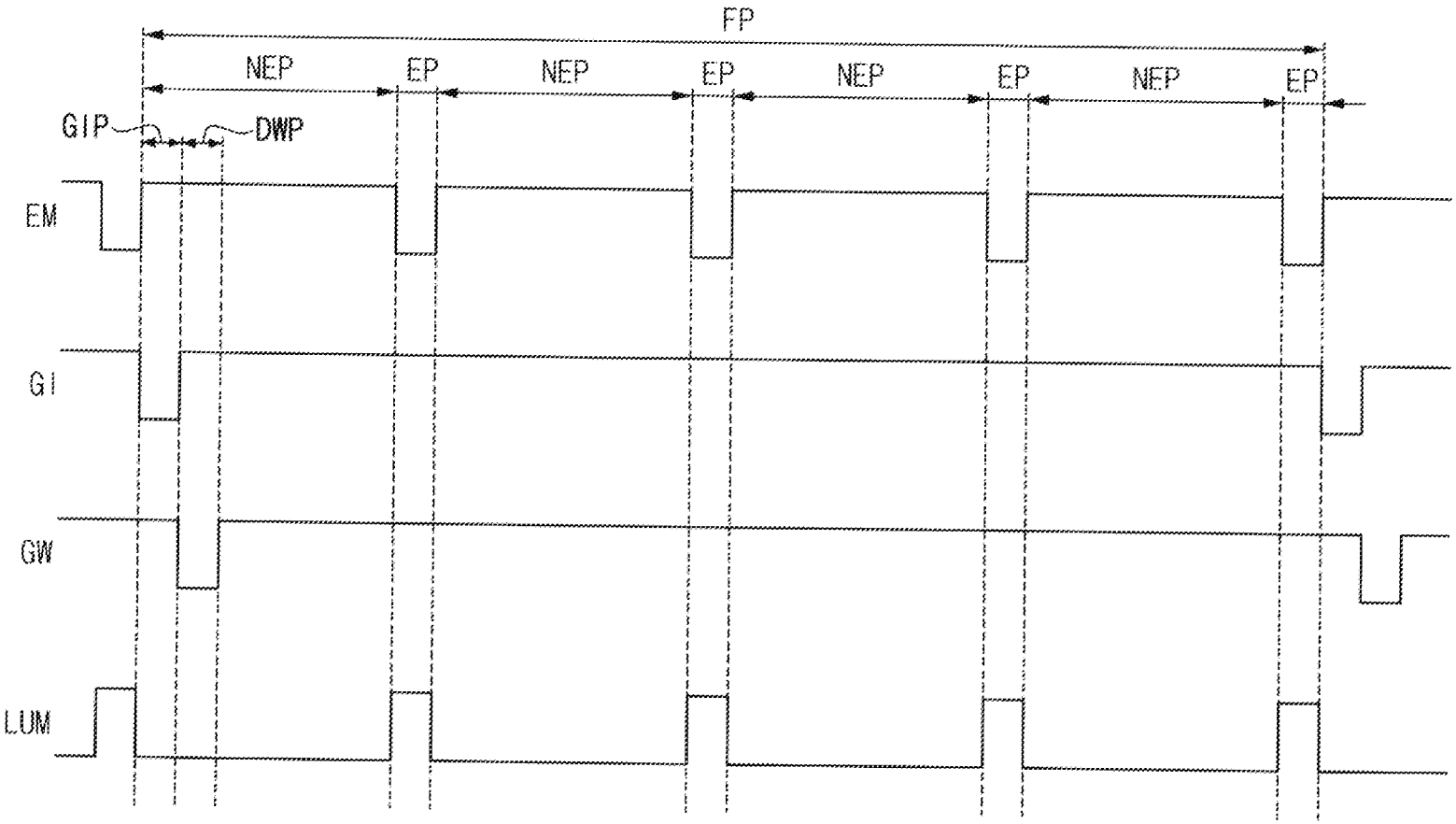
FIG. 2 is a timing diagram for describing an example of an operation of a pixel of FIG. 1.
Figure 3:
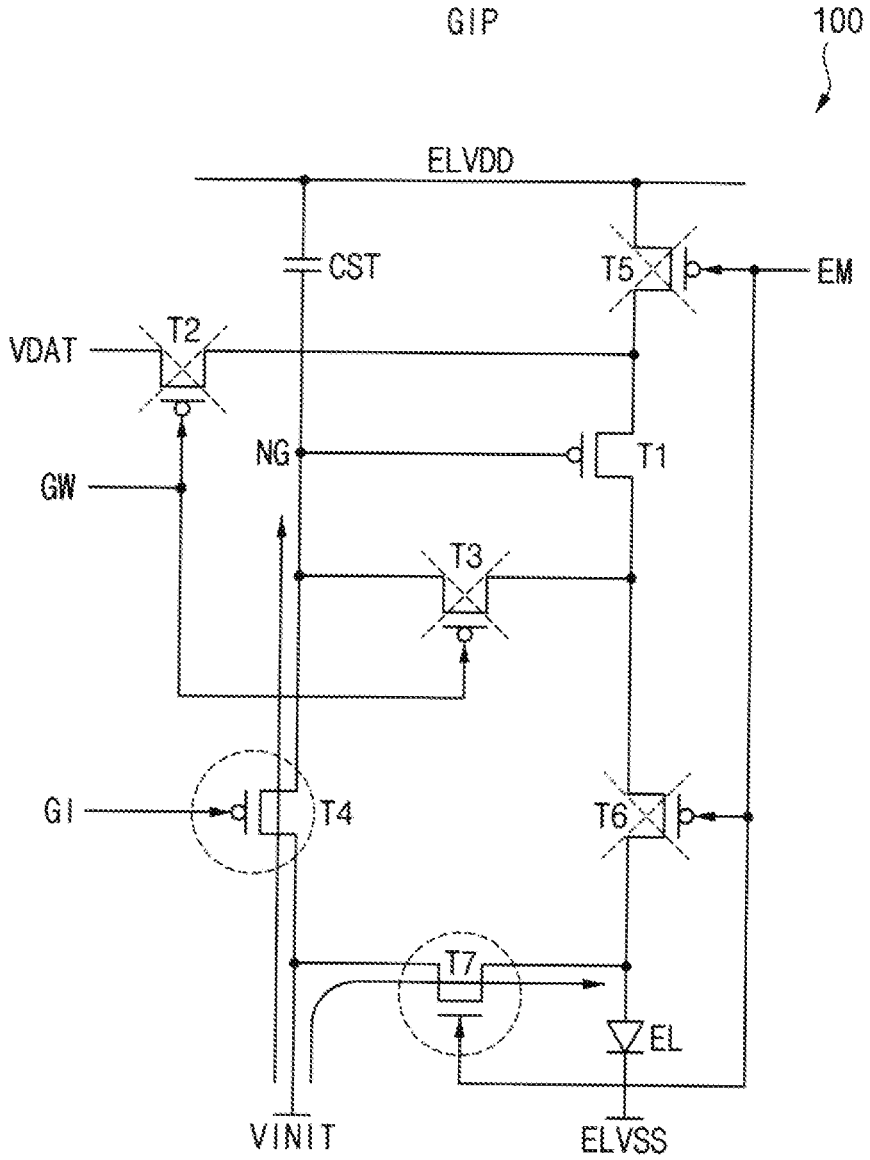
FIG. 3 is a circuit diagram for describing an operation of a pixel of FIG. 1 in a gate initialization period.
Figure 4:
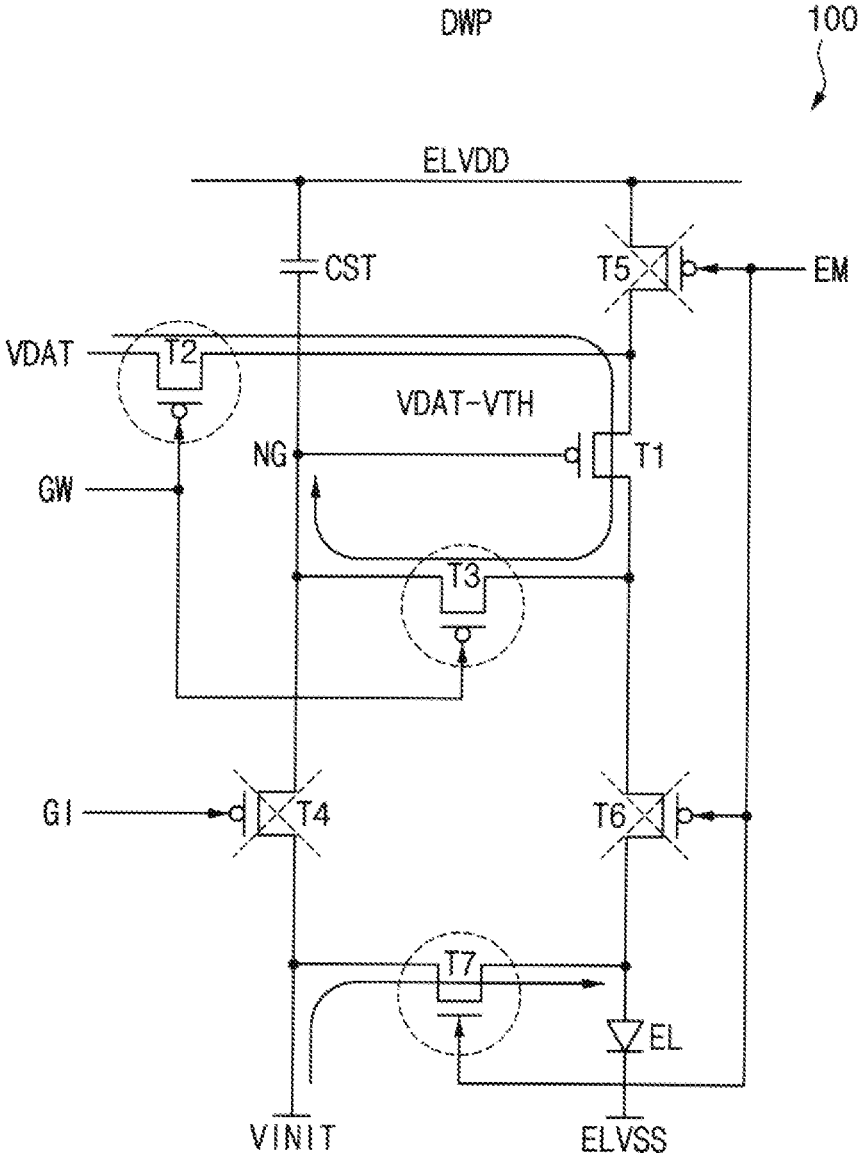
FIG. 4 is a circuit diagram for describing an operation of a pixel of FIG. 1 in a data writing period.
Figure 5:
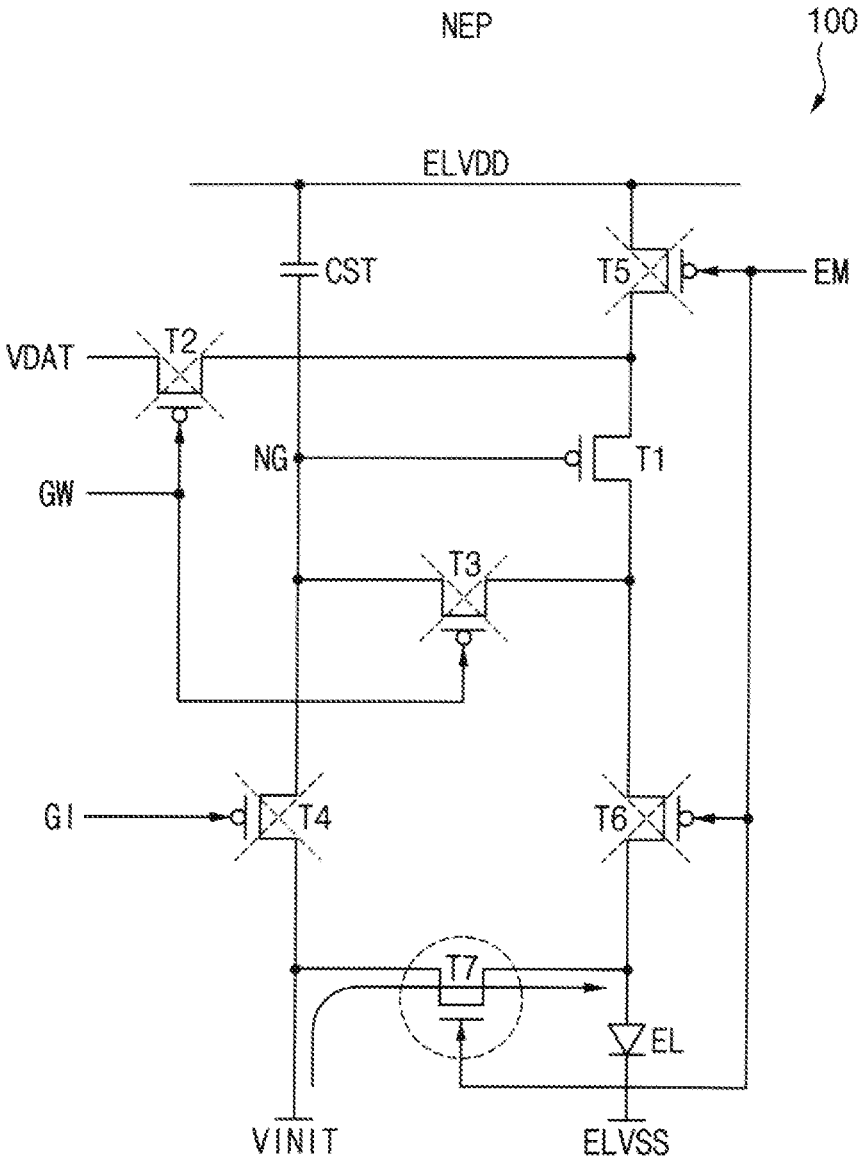
FIG. 5 is a circuit diagram for describing an operation of a pixel of FIG. 1 in a non-emission period except a gate initialization period and a data writing period.
Figure 6:
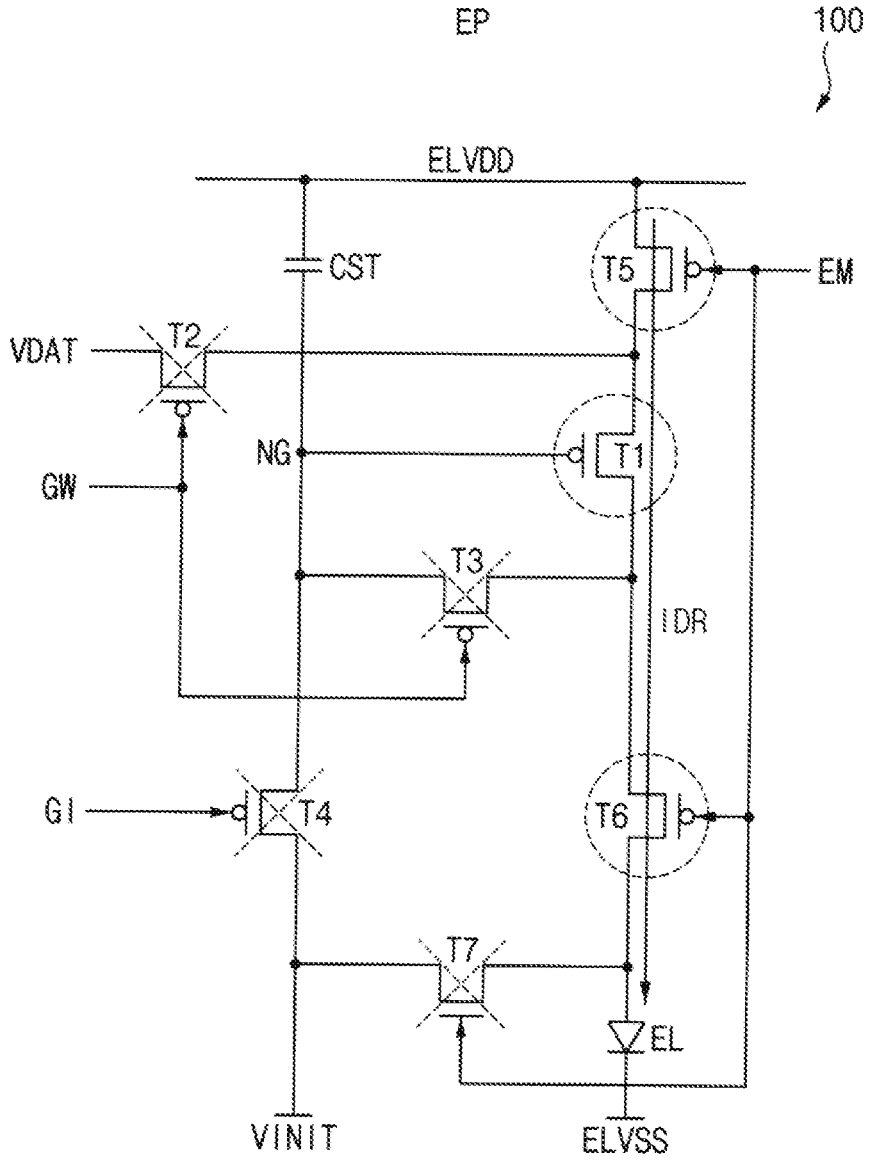
FIG. 6 is a circuit diagram for describing an operation of a pixel of FIG. 1 in an emission period.
Figure 7:
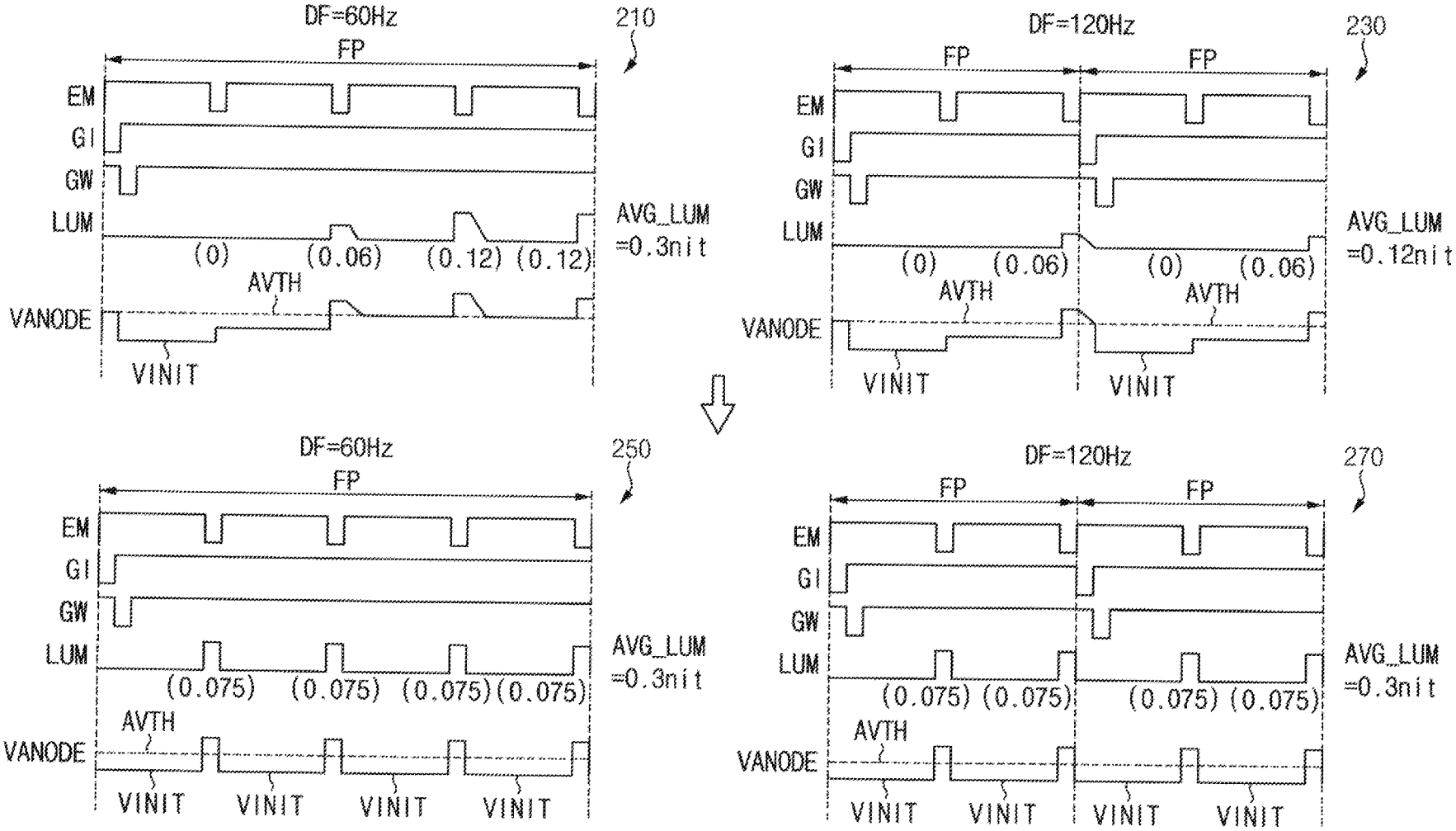
FIG. 7 is a diagram illustrating examples of luminance of a conventional pixel driven at driving frequencies of about 60 Hz and about 120 Hz, and examples of luminance of a pixel driven at driving frequencies of about 60 Hz and about 120 Hz according to embodiments.
Figure 8:
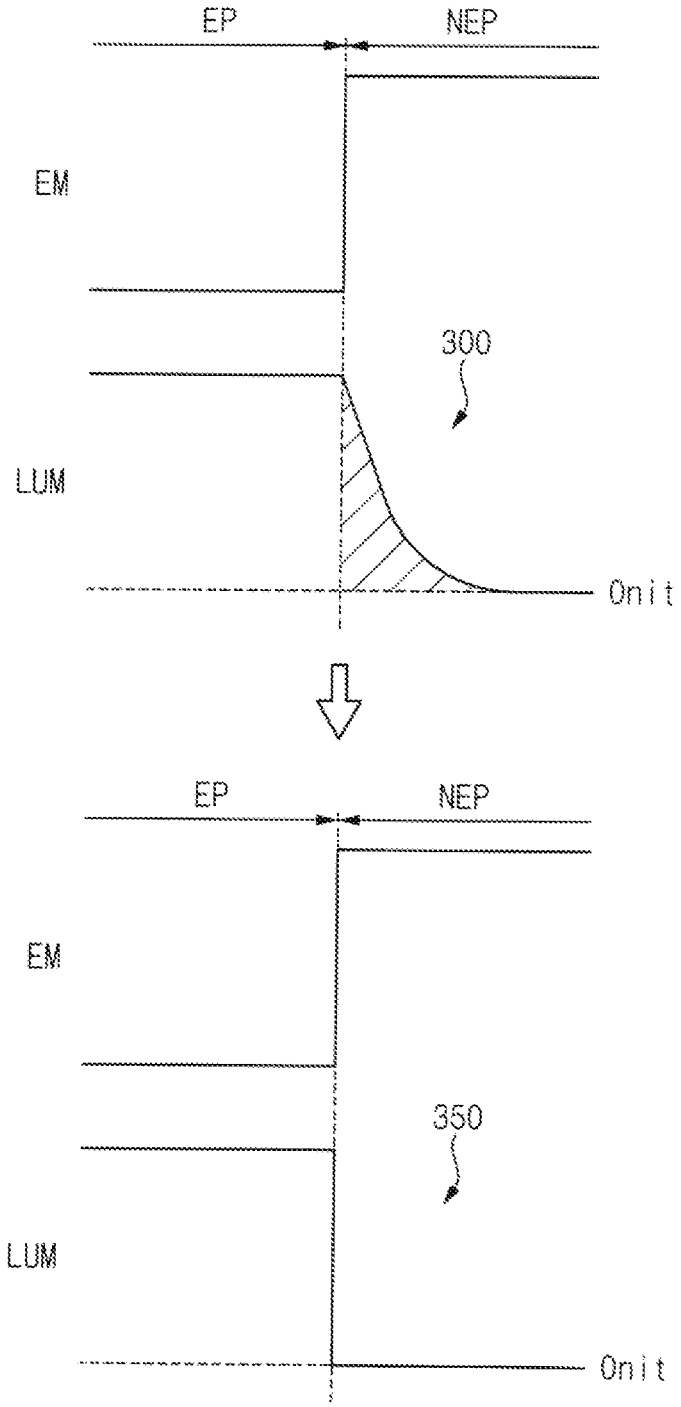
FIG. 8 is a diagram illustrating an example of a luminance of a conventional pixel in an initial period of a non-emission period, and an example of a luminance of a pixel driven in an initial period of a non-emission period according to embodiments.

FIG. 2 is a timing diagram for describing an example of an operation of a pixel of FIG. 1, FIG. 3 is a circuit diagram for describing an operation of a pixel of FIG. 1 in a gate initialization period, FIG. 4 is a circuit diagram for describing an operation of a pixel of FIG. 1 in a data writing period, FIG. 5 is a circuit diagram for describing an operation of a pixel of FIG. 1 in a non-emission period except a gate initialization period and a data writing period, FIG. 6 is a circuit diagram for describing an operation of a pixel of FIG. 1 in an emission period, FIG. 7 is a diagram illustrating examples of luminance of a conventional pixel driven at driving frequencies of about 60 Hz and about 120 Hz, and examples of luminance of a pixel driven at driving frequencies of about 60 Hz and about 120 Hz according to embodiments, and FIG. 8 is a diagram illustrating an example of a luminance of a conventional pixel in an initial period of a non-emission period, and an example of a luminance of a pixel driven in an initial period of a non-emission period according to embodiments.

Referring to FIGS. 1 and 2, a frame period FP for the pixel 100 may include a plurality of non-emission periods NEP in which the light emitting diode EL does not emit light, and a plurality of emission periods EP in which the light emitting diode EL emits light. Each emission period EP may be between the plurality of non-emission periods NEP. In some embodiments, the light emitting display device including the pixel 100 may perform an AOR driving operation that allows each pixel 100 to periodically emit (and not emit) within one frame period FP in order to adjust a ratio (e.g., AOR) of the non-emission period NEP to the one frame period FP. Further, in some embodiments, a first non-emission period NEP of each frame period FP may include a gate initialization period GIP and a data writing period DWP.

In the gate initialization period GIP, the gate node NG, or the second electrode of the storage capacitor CST and the gate of the driving transistor T1 may be initialized, and the light emitting diode EL may be initialized. For example, as illustrated in FIGS. 2 and 3, in the gate initialization period GIP, the gate initialization signal GI having a low level may be applied, and the emission signal EM having a high level may be applied. The gate initialization transistor T4 may be turned on in response to the gate initialization signal GI having the low level, the turned-on gate initialization transistor T4 may transfer the initialization voltage VINIT to the gate node NG, and the gate node NG may be initialized based on the initialization voltage VINIT. Further, the diode initialization transistor T7 may be turned on in response to the emission signal EM having the high level, the turned-on diode initialization transistor T7 may transfer the initialization voltage VINIT to the light emitting diode EL, and the light emitting diode EL may be initialized based on the initialization voltage VINIT. Although FIG. 3 illustrates an example where the gate node NG and the light emitting diode EL are initialized based on the same initialization voltage VINIT, in other embodiments, the gate node NG and the light emitting diode EL may be initialized based on different initialization voltages. Thus, in other embodiments, the gate initialization transistor T4 and the diode initialization transistor T7 may transfer the different initialization voltages from each other.

In the data writing period DWP, the storage voltage VDAT-VTH may be stored in the storage capacitor CST, and the light emitting diode EL may be initialized. For example, as illustrated in FIGS. 2 and 4, in the data writing period DWP, the gate writing signal GW having the low level may be applied, and the emission signal EM having the high level may be applied. The switching transistor T2 and the compensation transistor T3 may be turned on in response to the gate writing signal GW having the low level, the turned-on compensation transistor T3 may diode-connect the driving transistor T1, and the turned-on switching transistor T2 may transfer the data voltage VDAT to the storage capacitor CST through the diode-connected driving transistor T1. Thus, the storage capacitor CST may store a storage voltage VDAT-VTH where a threshold voltage VTH of the driving transistor T1 is subtracted from the data voltage VDAT, or the storage voltage VDAT-VTH where the threshold voltage VTH of the driving transistor T1 is compensated. Further, the diode initialization transistor T7 may be turned on in response to the emission signal EM having the high level, the turned-on diode initialization transistor T7 may transfer the initialization voltage VINIT to the light emitting diode EL, and the light emitting diode EL may be initialized based on the initialization voltage VINIT.

Not only in the gate initialization period GIP and the data writing period DWP, but also in the non-emission period NEP except the gate initialization period GIP and the data writing period DWP, the light emitting diode EL may be initialized. For example, as illustrated in FIGS. 2 and 5, in the non-emission period NEP except the gate initialization period GIP and the data writing period DWP, the emission signal EM having the high level may be applied. The diode initialization transistor T7 may be turned on in response to the emission signal EM having the high level, the turned-on diode initialization transistor T7 may transfer the initialization voltage VINIT to the light emitting diode EL, and the light emitting diode EL may be initialized based on the initialization voltage VINIT.

In the emission period EP, the light emitting diode EL may emit light. For example, as illustrated in FIGS. 2 and 6, in the emission period EP, the emission signal EM having the low level may be applied. The driving transistor T1 may generate the driving current IDR based on the storage voltage VDAT-VTH stored in the storage capacitor CST, or the storage voltage VDAT-VTH where the threshold voltage VTH of the driving transistor T1 is compensated, and the emission transistor T5 and T6 may form the path of the driving current IDR in response to the emission signal EM having the low level. Thus, the driving current IDR generated by the driving transistor T1 may be provided to the light emitting diode EL, and the light emitting diode EL may emit light with a desired luminance LUM based on the driving current IDR in each emission period EP.

In a pixel of a conventional light emitting display device, the numbers of times of initialization of a light emitting diode of the pixel driven at different driving frequencies may be different from each other, and luminance of the pixel driven at the different driving frequencies may be different from each other. For example, in the conventional pixel driven at a first driving frequency DF of about 60 Hz, as illustrated in a timing diagram 210 of FIG. 7, a diode initialization transistor may be turned on in response to a gate writing signal GW (or a gate bypass signal), and an anode voltage VANODE of the light emitting diode EL may be initialized to the initialization voltage VINIT once for a time corresponding to one frame period FP. Further, one frame period FP corresponding to the first driving frequency DF of about 60 Hz may include four emission periods. In a first emission period after the light emitting diode EL is initialized, a parasitic capacitor of the light emitting diode EL may not be sufficiently charged by a driving current, the anode voltage VANODE of the light emitting diode EL may not reach a threshold voltage AVTH of the light emitting diode EL, and thus the light emitting diode EL may not emit light. Further, the light emitting diode EL may emit light in a second emission period such that an area of a luminance LUM in the second emission period may correspond to an average luminance AVG_LUM of about 0.06 nit for the time corresponding to one frame period FP, and may emit light in each of third and fourth emission periods such that an area of the luminance LUM in each of the third and fourth emission periods may correspond to an average luminance AVG_LUM of about 0.12 nit for the time. Thus, the conventional pixel driven at the first driving frequency DF of about 60 Hz may have an average luminance AVG_LUM of about 0.3 nit for the time corresponding to one frame period FP.

Further, in the conventional pixel driven at a second driving frequency DF of about 120 Hz, as illustrated in a timing diagram 230 of FIG. 7, for the time corresponding to one frame period FP at the first driving frequency DF of about 60 Hz, or the time corresponding to two frame periods FP at the second driving frequency DF of about 120 Hz, the anode voltage VANODE of the light emitting diode EL may be initialized to the initialization voltage VINIT twice. Further, one frame period FP corresponding to the second driving frequency DF of about 120 Hz may include two emission periods. In a first emission period after the light emitting diode EL is initialized, the light emitting diode EL may not emit light. Further, in a second emission period, the light emitting diode EL may emit light such that an area of a luminance LUM in the second emission period may correspond to an average luminance AVG_LUM of about 0.06 nit for the time. Thus, the conventional pixel driven at the second driving frequency DF of about 120 Hz may have an average luminance AVG_LUM of about 0.12 nit for the time corresponding to two frame periods FP. Accordingly, since, for the substantially the same time, the conventional pixel driven at the first driving frequency DF of about 60 Hz has the average luminance AVG_LUM of about 0.3 nit, and the conventional pixel driven at the second driving frequency DF of about 120 Hz has the average luminance AVG_LUM of about 0.12 nit, luminance of the conventional pixel driven at the different first and second driving frequencies DF may be different from each other.

However, in the pixel 100 according to embodiments, the numbers of times of initialization of the light emitting diode EL of the pixel 100 driven at different driving frequencies may be substantially the same as each other, and luminance of the pixel 100 driven at the different driving frequencies may be substantially the same as each other. For example, in the pixel 100 driven at the first driving frequency DF of about 60 Hz, as illustrated in a timing diagram 250 of FIG.

7, the diode initialization transistor T7 may be turned on in response to the emission signal EM having the high level, and an anode voltage VANODE of the light emitting diode EL may be initialized to the initialization voltage VINIT in the entire period of the plurality of non-emission periods. Thus, the anode voltage VANODE of the light emitting diode EL at end time points of the respective non-emission periods, or at start time points of the respective emission periods may be substantially the same initialization voltage VINIT, and the pixel 100 may have substantially the same luminance in the respective emission periods. Further, in the pixel 100 according to embodiments, the data voltage VDAT may be set such that an area of a luminance LUM in each emission period may correspond to an average luminance AVG_LUM of about 0.075 nit for a time corresponding to one frame period FP. Thus, the pixel 100 driven at the first driving frequency DF of about 60 Hz may have an average luminance AVG_LUM of about 0.3 nit for the time corresponding to one frame period FP.

Further, in the pixel 100 driven at a second driving frequency DF of about 120 Hz, as illustrated in a timing diagram 270 of FIG. 7, the anode voltage VANODE of the light emitting diode EL may be initialized to the initialization voltage VINIT in the entire period of the plurality of non-emission periods, and the pixel 100 may have substantially the same luminance in the respective emission periods. Further, the pixel 100 driven at the second driving frequency DF of about 120 Hz may have an average luminance AVG_LUM of about 0.3 nit for the time corresponding to two frame periods FP. Accordingly, since, for the substantially the same time, the pixel 100 driven at the first driving frequency DF of about 60 Hz has the average luminance AVG_LUM of about 0.3 nit, and the pixel 100 driven at the second driving frequency DF of about 120 Hz has the average luminance AVG_LUM of about 0.3 nit, luminance of the pixel 100 driven at the different first and second driving frequencies DF may be substantially the same as each other.

Further, the conventional pixel may undesirably emit light in an initial period of each non-emission period. For example, as illustrated in a timing diagram 300 of FIG. 8, the conventional pixel may undesirably emit light based on remaining charges stored in the parasitic capacitor of the light emitting diode in the initial period of each non-emission period NEP. However, in the pixel 100 according to embodiments, the light emitting diode EL may be initialized in the entire period of the plurality of non-emission periods NEP. Thus, as illustrated in a timing diagram 350 of FIG. 8, since the parasitic capacitor of the light emitting diode EL is discharged in the entire non-emission period NEP, the pixel 100 according to embodiments may not undesirably emit light in the initial period of each non-emission period NEP.

Figure 9:
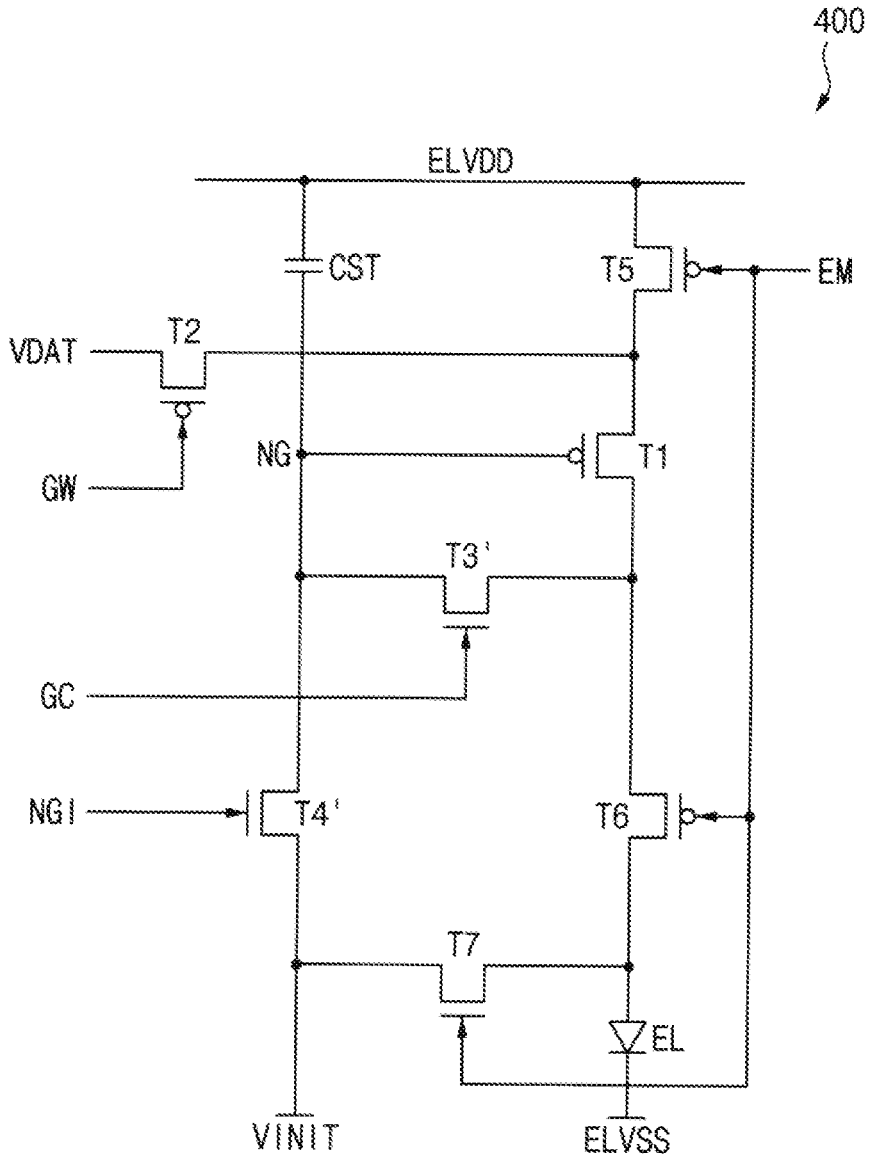
FIG. 9 is a circuit diagram illustrating a pixel of a light emitting display device according to another embodiment.
Figure 10:
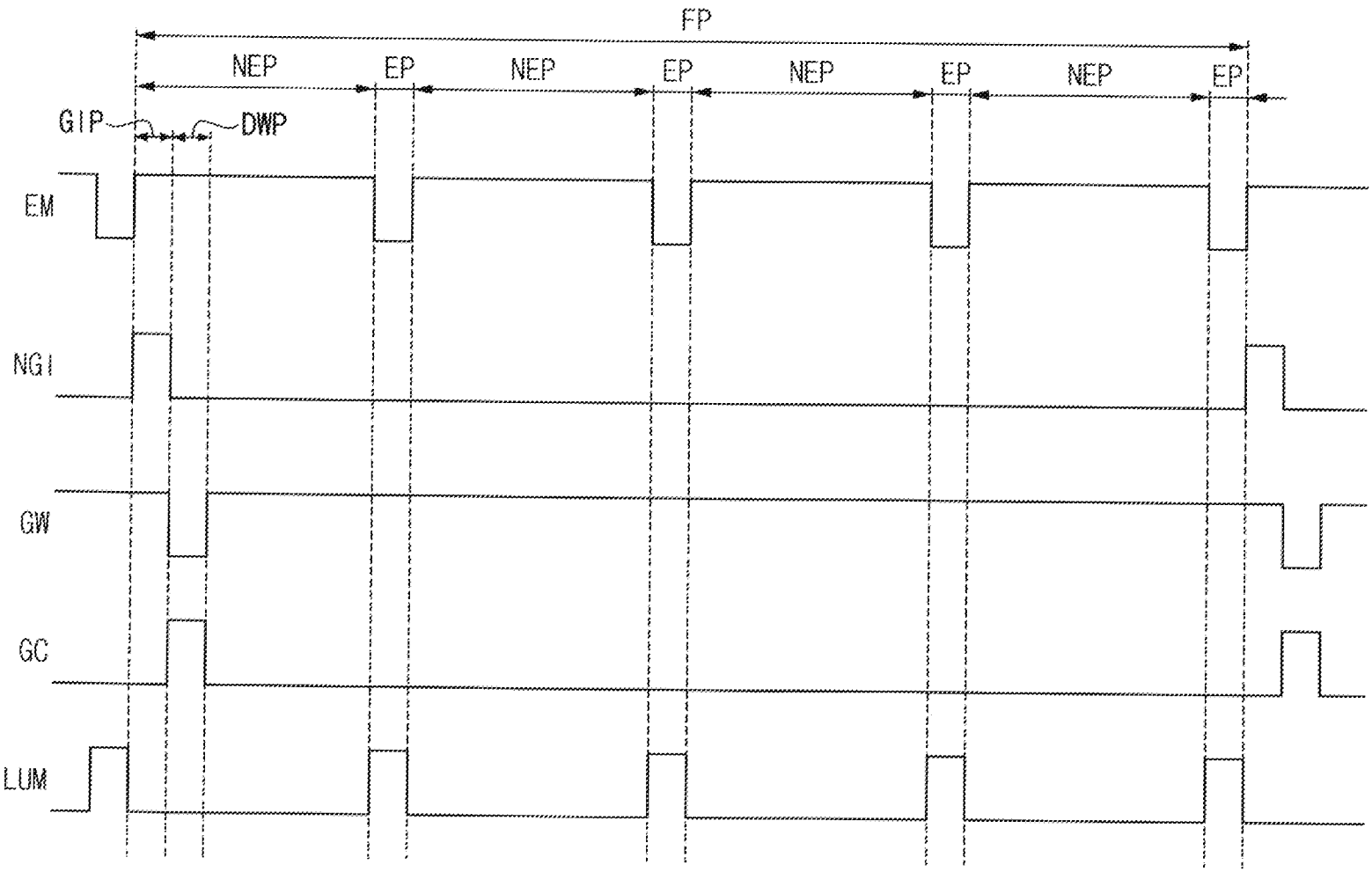
FIG. 10 is a timing diagram for describing an example of an operation of a pixel of FIG. 9.

FIG. 9 is a circuit diagram illustrating a pixel of a light emitting display device according to another embodiment, and FIG. 10 is a timing diagram for describing an example of an operation of a pixel of FIG. 9.

Referring to FIGS. 9 and 10, a pixel 400 of a light emitting display device (e.g., an OLED display device) according to embodiments may include a capacitor CST (or a storage capacitor), a transistor T1 (or a driving transistor), a second transistor T2 (or switching transistor), a third transistor T3' (or a compensation transistor), a fourth transistor T4' (or a gate initialization transistor), a fifth transistor T5 (or a first emission transistor), a sixth transistor T6 (or a second emission transistor), a seventh transistor T7 (or a diode initialization transistor), and a light emitting diode EL (e.g., an OLED). The pixel 400 of FIG. 9 may have a similar configuration and a similar operation to a pixel 100 of FIG. 1, except that the third transistor T3' and the fourth transistor T4' may be implemented with NMOS transistors. In the pixel 400 according to embodiments, the first, second, fifth and sixth transistors T1, T2, T5 and T6 may be implemented with PMOS transistors, and the third, fourth and seventh transistors T3', T4' and T7 may be implemented with NMOS transistors.

The third transistor T3' may receive a gate compensation signal GC, and the fourth transistor T4' may receive a gate initialization signal NGI. As illustrated in FIGS. 9 and 10, unlike a gate writing signal GW and an emission signal EM that are active low signals having a low level as a turn-on level, the gate compensation signal GC and the gate initialization signal NGI may be active high signals having a high level as the turn-on level. The third transistor T3' may be turned on in response to the gate compensation signal GC having the high level, and the fourth transistor T4' may be turned on in response to the gate initialization signal NGI having the high level.

Figure 11:
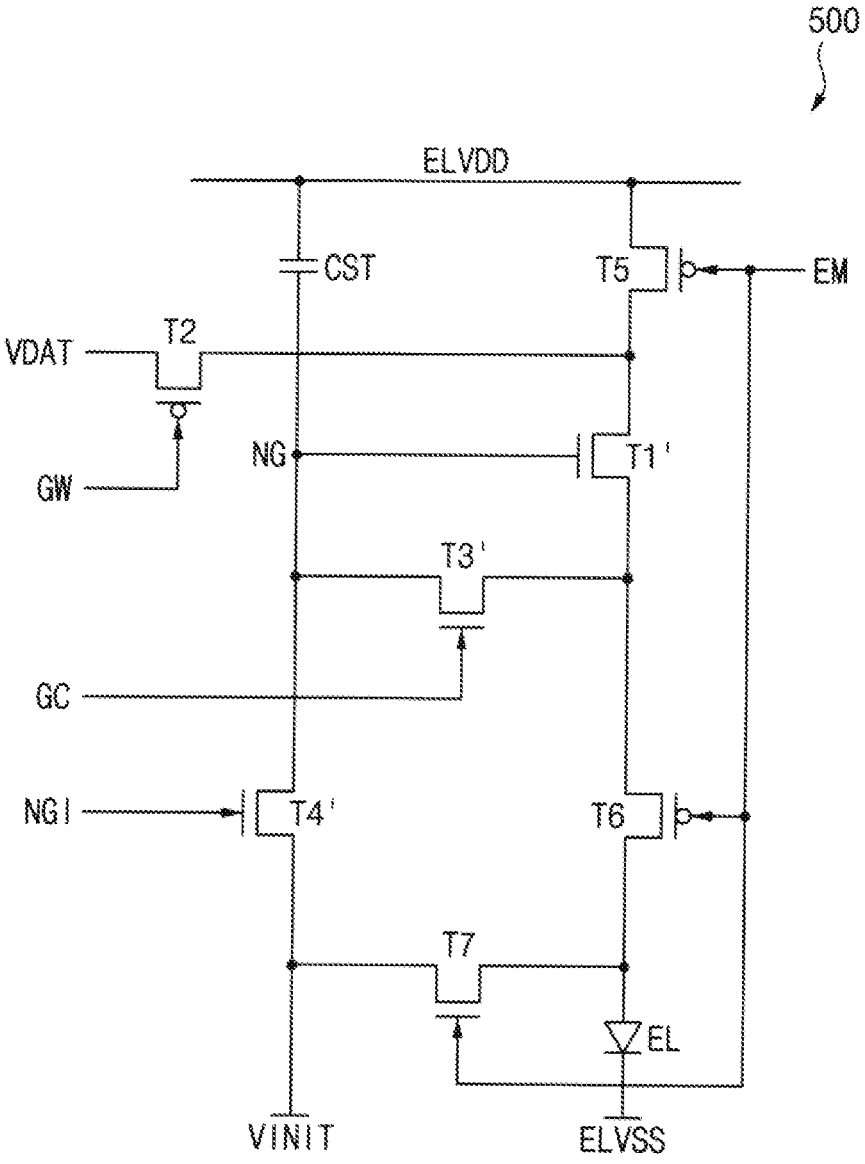
FIG. 11 is a circuit diagram illustrating a pixel of a light emitting display device according to still another embodiment.

FIG. 11 is a circuit diagram illustrating a pixel of a light emitting display device according to still another embodiment.

Referring to FIG. 11, a pixel 500 of a light emitting display device (e.g., an OLED display device) according to embodiments may include a capacitor CST (or a storage capacitor), a transistor T1' (or a driving transistor), a second transistor T2 (or switching transistor), a third transistor T3' (or a compensation transistor), a fourth transistor T4' (or a gate initialization transistor), a fifth transistor T5 (or a first emission transistor), a sixth transistor T6 (or a second emission transistor), a seventh transistor T7 (or a diode initialization transistor), and a light emitting diode EL (e.g., an OLED). The pixel 500 of FIG. 11 may have a similar configuration and a similar operation to a pixel 100 of FIG. 1, except that the first transistor T1', the third transistor T3' and the fourth transistor T4' may be implemented with NMOS transistors. In the pixel 500 according to embodiments, the second, fifth and sixth transistors T2, T5 and T6 may be implemented with PMOS transistors, and the first, third, fourth and seventh transistors T1', T3', T4' and T7 may be implemented with NMOS transistors.

Figure 12:
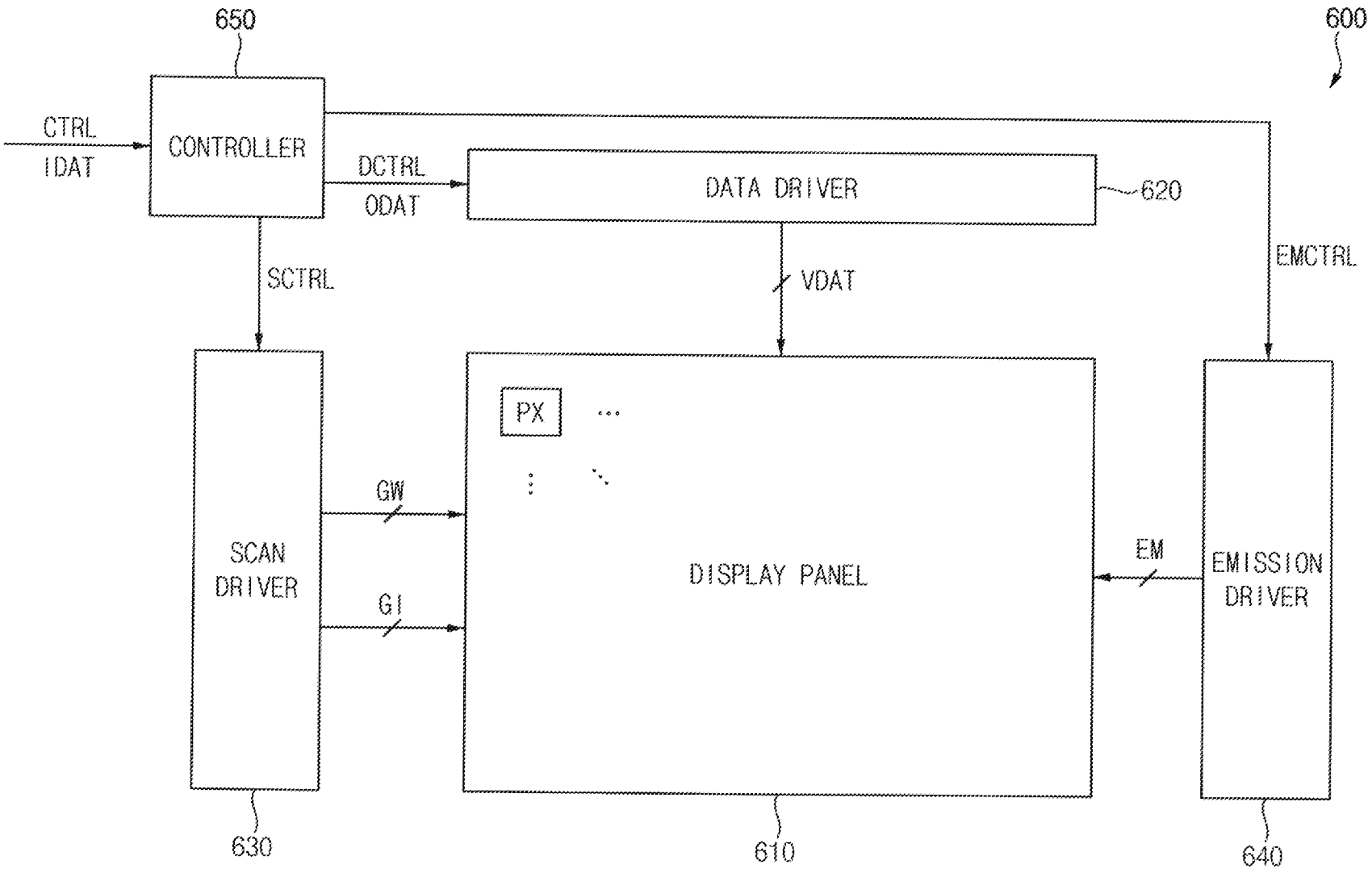
FIG. 12 is a block diagram illustrating a light emitting display device according to embodiments.

FIG. 12 is a block diagram illustrating a light emitting display device according to embodiments.

Referring to FIG. 12, a light emitting display device 600 (e.g., an OLED display device) according to embodiments may include a display panel 610 including a plurality of pixels PX, a data driver 620 providing data voltages VDAT to the plurality of pixels PX, a scan driver 630 providing gate writing signals GW and gate initialization signals GI to the plurality of pixels PX, an emission driver 640 providing emission signals EM to the plurality of pixels PX, and a controller 650 controlling the data driver 620, the scan driver 630 and the emission driver 640.

The display panel 610 may include the plurality of pixels PX. According to embodiments, each pixel PX of the display panel 610 may be a pixel 100 of FIG. 1, a pixel 400 of FIG. 9, a pixel 500 of FIG. 11, or the like. For example, each pixel PX may include a switching transistor that transfers the data voltage VDAT in response to the gate writing signal GW, a storage capacitor that stores the storage voltage VDAT-VTH corresponding to a value obtained by subtracting a threshold voltage VTH of the driving transistor T1 from the data voltage VDAT, a driving transistor that generates a driving current based on the storage voltage VDAT-VTH stored in the storage capacitor, an emission transistor that selectively forms a path of the driving current in response to the emission signal EM, a light emitting diode that emits light based on the driving current, and a diode initialization transistor that transfers an initialization voltage to the light emitting diode in response to the emission signal EM.

The data driver 620 may provide the data voltages VDAT to the plurality of pixels PX based on output image data ODAT and a data control signal DCTRL received from the controller 650. In some embodiments, the data control signal DCTRL may include, but not limited to, an output data enable signal, a horizontal start signal and a load signal. In some embodiments, the data driver 620 and the controller 650 may be implemented with a single integrated circuit, and the single integrated circuit may be referred to as a timing controller embedded data driver ("TED"). In other embodiments, the data driver 620 and the controller 650 may be implemented with separate integrated circuits.

The scan driver 630 may provide the gate writing signals GW and the gate initialization signals GI to the plurality of pixels PX based on a scan control signal SCTRL received from the controller 650. In some embodiments, the scan control signal SCTRL may include, but not limited to, a scan start signal and a scan clock signal. In some embodiments, the scan driver 630 may be integrated or formed in a peripheral portion of the display panel 610. In other embodiments, the scan driver 630 may be integrated or formed in a display region of the display panel 610. In still other embodiments, the scan driver 630 may be implemented with one or more integrated circuits.

The emission driver 640 may provide the emission signals EM to the plurality of pixels PX based on an emission control signal EMCTRL received from the controller 650. The emission control signal EMCTRL may include, but not limited to, an emission start signal and an emission clock signal. In some embodiments, the light emitting display device 600 may perform an AOR driving operation, and the emission driver 640 may generate the emission signals EM such that each emission signal EM may periodically alternate between a first level (e.g., a low level) and a second level (e.g., a high level) in each frame period. The emission transistor of each pixel PX may be turned on in response to the emission signal EM having the first level (e.g., the low level), and the diode initialization transistor of each pixel PX may be turned on in response to the emission signal EM having the second level (e.g., the high level). In some embodiments, the emission driver 640 may be integrated or formed in the peripheral portion of the display panel 610. In other embodiments, the emission driver 640 may be integrated or formed in the display region of the display panel 610. In still other embodiments, the emission driver 640 may be implemented with one or more integrated circuits.

The controller 650 (e.g., a timing controller) may receive input image data IDAT and a control signal CTRL from an external host processor (e.g., a graphics processing unit ("GPU"), an application processor ("AP") or a graphics card). In some embodiments, the input image data IDAT may be RGB image data including red image data, green image data and blue image data. In some embodiments, the control signal CTRL may include, but not limited to, a vertical synchronization signal, a horizontal synchronization signal, an input data enable signal, a master clock signal, etc. The controller 650 may generate the output image data ODAT, the data control signal DCTRL, the scan control signal SCTRL and the emission control signal EMCTRL based on the input image data IDAT and the control signal CTRL. The controller 650 may control an operation of the data driver 620 by providing the output image data ODAT and the data control signal DCTRL to the data driver 620, may control an operation of the scan driver 630 by providing the scan control signal SCTRL to the scan driver 630, and may control an operation of the emission driver 640 by providing the emission control signal EMCTRL to the emission driver 640.

In the light emitting display device 600 according to embodiments, each pixel PX may include the switching transistor, the storage capacitor, the driving transistor, the emission transistor, the light emitting diode and the diode initialization transistor, and the diode initialization transistor may transfer the initialization voltage to the light emitting diode in response to the emission signal EM applied to the emission transistor. Thus, the diode initialization transistor may be turned on to perform a diode initialization operation for an entire period of a plurality of non-emission periods included in one frame period. Accordingly, the pixel PX may have a substantially constant luminance at different driving frequencies, and may prevent an undesired emission of the pixel PX in an initial period of each non-emission period.

Figure 13:
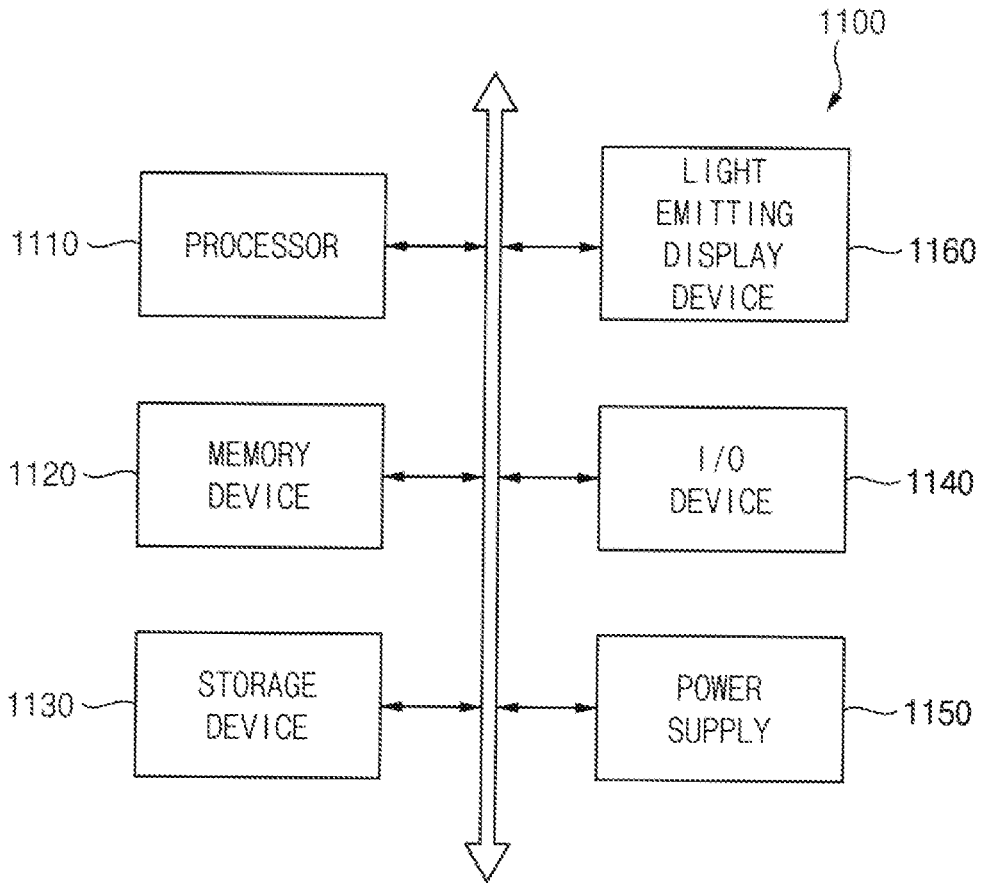
FIG. 13 is a block diagram illustrating an electronic device including a light emitting display device according to embodiments.

FIG. 13 is a block diagram illustrating an electronic device including a light emitting display device according to embodiments.

Referring to FIG. 13, an electronic device 1100 may include a processor 1110, a memory device 1120, a storage device 1130, an input/output ("I/O") device 1140, a power supply 1150, and a light emitting display device (e.g., an OLED display device) 1160. The electronic device 1100 may further include a plurality of ports for communicating with a video card, a sound card, a memory card, a universal serial bus ("USB") device, other electric devices, etc.

The processor 1110 may perform various computing functions or tasks. The processor 1110 may be an application processor (AP), a microprocessor, a central processing unit (CPU), etc. The processor 1110 may be coupled to other components via an address bus, a control bus, a data bus, etc. Further, in some embodiments, the processor 1110 may be further coupled to an extended bus such as a peripheral component interconnection ("PCI") bus.

The memory device 1120 may store data for operations of the electronic device 1100. For example, the memory device 1120 may include at least one non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, etc, and/or at least one volatile memory device such as a dynamic random access memory ("DRAM") device, a static random access memory ("SRAM") device, a mobile dynamic random access memory (mobile DRAM) device, etc.

The storage device 1130 may be a solid state drive ("SSD") device, a hard disk drive ("HDD") device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The OLED display device 1160 may be coupled to other components through the buses or other communication links.

In the light emitting display device 1160, each pixel may include a switching transistor, a storage capacitor, a driving transistor, an emission transistor, a light emitting diode and a diode initialization transistor, and the diode initialization transistor may transfer an initialization voltage to the light emitting diode in response to an emission signal applied to the emission transistor. Thus, the diode initialization transistor may be turned on to perform a diode initialization operation for an entire period of a plurality of non-emission periods included in one frame period. Accordingly, the pixel may have a substantially constant luminance at different driving frequencies, and may prevent an undesired emission of the pixel in an initial period of each non-emission period.

The inventive concepts may be applied to any light emitting display device 1160 supporting the variable frame mode, and any electronic device 1100 including the light emitting display device 1160. For example, the inventive concepts may be applied to a smart phone, a wearable electronic device, a tablet computer, a mobile phone, a television ("TV"), a digital TV, a 3D TV, a personal computer ("PC"), a home appliance, a laptop computer, a personal digital assistant ("PDA"), a portable multimedia player ("PMP"), a digital camera, a music player, a portable game console, a navigation device, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A pixel of a light emitting display device, the pixel comprising:

a switching transistor which transfers a data voltage in response to a gate writing signal;

a storage capacitor which stores a storage voltage;

a driving transistor which generates a driving current based on the storage voltage stored in the storage capacitor;

an emission transistor which selectively forms a path of the driving current in response to an emission signal;

a light emitting diode which emits light based on the driving current; and a diode initialization transistor which transfers an initialization voltage to the light emitting diode to initialize the light emitting diode in response to the emission signal, wherein the storage voltage corresponds to a value obtained by subtracting a threshold voltage of the driving transistor from the data voltage, wherein a total number of times of initialization of the light emitting diode driven at a first driving frequency is the same as a total number of times of initialization of the light emitting diode driven at a second frequency different from the first driving frequency.

2. The pixel of claim 1, wherein the emission transistor is turned on in response to the emission signal when the emission signal has a first level, and wherein the diode initialization transistor is turned on in response to the emission signal when the emission signal has a second level different from the first level.

3. The pixel of claim 1, wherein a frame period includes a plurality of non-emission periods, and a plurality of emission periods between the plurality of non-emission periods, and wherein the diode initialization transistor is turned on for an entire period of the plurality of non-emission periods.

4. The pixel of claim 1, wherein the emission transistor is implemented with a first conductive type transistor, and wherein the diode initialization transistor is implemented with a second conductive type transistor which is different from the first conductive type transistor.

5. The pixel of claim 1, wherein the emission transistor is implemented with a p-type metal-oxide-semiconductor (PMOS) transistor, and wherein the diode initialization transistor is implemented with an n-type metal-oxide-semiconductor (NMOS) transistor.

6. The pixel of claim 1, wherein the diode initialization transistor includes a gate which receives the emission signal, a first terminal coupled to the light emitting diode, and a second terminal which receives the initialization voltage.

7. The pixel of claim 1, wherein the storage capacitor includes a first electrode coupled to a line which supplies a first power supply voltage, and a second electrode coupled to a gate node, wherein the driving transistor includes:

a first transistor including a gate coupled to the gate node, a first terminal, and a second terminal, wherein the switching transistor includes:

a second transistor including a gate which receives the gate writing signal, a first terminal which receives the data voltage, and a second terminal coupled to the first terminal of the first transistor, wherein the emission transistor includes:

a fifth transistor including a gate which receives the emission signal, a first terminal coupled to the line which supplies the first power supply voltage, and a second terminal coupled to the first terminal of the first transistor; and a sixth transistor including a gate which receives the emission signal, a first terminal coupled to the second terminal of the first transistor, and a second terminal coupled to the light emitting diode, and wherein the light emitting diode includes an anode coupled to the second terminal of the sixth transistor, and a cathode coupled to a line which supplies a second power supply voltage.

8. The pixel of claim 7, further comprising:

a compensation transistor which diode-connects the driving transistor in response to the gate writing signal; and a gate initialization transistor which transfers the initialization voltage to the gate node in response to a gate initialization signal.

9. The pixel of claim 8, wherein the compensation transistor includes:

a third transistor including a gate receiving the gate writing signal, a first terminal coupled to the second terminal of the first transistor, and a second terminal coupled to the gate node, and wherein the gate initialization transistor includes:

a fourth transistor including a gate receiving the gate initialization signal, a first terminal coupled to the gate node, and a second terminal which receives the initialization voltage.

10. A pixel of a light emitting display device, the pixel comprising:

a capacitor including a first electrode coupled to a line which supplies a first power supply voltage, and a second electrode coupled to a gate node;

a first transistor including a gate coupled to the gate node, a first terminal, and a second terminal;

a second transistor including a gate which receives a gate writing signal, a first terminal which receives a data voltage, and a second terminal coupled to the first terminal of the first transistor;

a third transistor including a gate which receives the gate writing signal, a first terminal coupled to the second terminal of the first transistor, and a second terminal coupled to the gate node;

a fourth transistor including a gate which receives a gate initialization signal, a first terminal coupled to the gate node, and a second terminal which receives an initialization voltage;

a fifth transistor including a gate which receives an emission signal, a first terminal coupled to the line which supplies the first power supply voltage, and a second terminal coupled to the first terminal of the first transistor;

a sixth transistor including a gate which receives the emission signal, a first terminal coupled to the second terminal of the first transistor, and a second terminal coupled to a light emitting diode;

a seventh transistor including a gate which receives the emission signal, a first terminal coupled to the light emitting diode, and a second terminal which receives the initialization voltage; and the light emitting diode including an anode coupled to the second terminal of the sixth transistor, and a cathode coupled to a line which supplies a second power supply voltage, wherein the light emitting diode is initialized based on the initialization voltage received from the seventh transistor, and a total number of times of initialization of the light emitting diode driven at a first driving frequency is the same as a total number of times of initialization of the light emitting diode driven at a second driving frequency different from the first driving frequency.

11. The pixel of claim 10, wherein the fifth and sixth transistors are turned on in response to the emission signal when the emission signal has a first level, and wherein the seventh transistor is turned on in response to the emission signal when the emission signal has a second level different from the first level.

12. The pixel of claim 10, wherein the fifth and sixth transistors are implemented with first conductive type transistors, and wherein the seventh transistor is implemented with a second conductive type transistor different from the first conductive type transistors.

13. The pixel of claim 10, wherein the first, second, third, fourth, fifth and sixth transistors are implemented with p-type metal-oxide-semiconductor (PMOS) transistors, and wherein the seventh transistor is implemented with an n-type metal-oxide-semiconductor (NMOS) transistor.

14. The pixel of claim 10, wherein the first, second, fifth and sixth transistors are implemented with PMOS transistors, and wherein the third, fourth and seventh transistors are implemented with NMOS transistors.

15. The pixel of claim 10, wherein the second, fifth and sixth transistors are implemented with PMOS transistors, and wherein the first, third, fourth and seventh transistors are implemented with NMOS transistors.

16. A light emitting display device comprising:

a display panel including a plurality of pixels;

a data driver which provides a data voltage to each of the plurality of pixels;

a scan driver which provides a gate writing signal and a gate initialization signal to each of the plurality of pixels; and an emission driver which provides an emission signal to each of the plurality of pixels, wherein each of the plurality of pixels includes:

a switching transistor which transfers the data voltage in response to the gate writing signal;

a storage capacitor which stores a storage voltage;

a driving transistor which generates a driving current based on the storage voltage stored in the storage capacitor;

an emission transistor which selectively forms a path of the driving current in response to the emission signal;

a light emitting diode which emits light based on the driving current; and a diode initialization transistor which transfers an initialization voltage to the light emitting diode to initialize the light emitting diode in response to the emission signal, wherein the storage voltage corresponds to a value obtained by subtracting a threshold voltage of the driving transistor from the data voltage, wherein a total number of times of initialization of the light emitting diode driven at a first driving frequency is the same as a total number of times of initialization of the light emitting diode driven at a second driving frequency different from the first driving frequency.

17. The light emitting display device of claim 16, wherein the emission driver generates the emission signal which periodically alternates between a first level and a second level in a frame period, wherein the first level is different from the second level, wherein the emission transistor is turned on in response to the emission signal when the emission signal has the first level, and wherein the diode initialization transistor is turned on in response to the emission signal when the emission signal has the second level.

18. The light emitting display device of claim 16, wherein a frame period includes a plurality of non-emission periods, and a plurality of emission periods between the plurality of non-emission periods, and wherein the diode initialization transistor is turned on for an entire period of the plurality of non-emission periods.

19. The light emitting display device of claim 16, wherein the emission transistor is implemented with a first conductive type transistor, and wherein the diode initialization transistor is implemented with a second conductive type transistor different from the first conductive type transistor.

20. The light emitting display device of claim 16, wherein the emission transistor is implemented with a p-type metal-oxide-semiconductor (PMOS) transistor, and wherein the diode initialization transistor is implemented with an n-type metal-oxide-semiconductor (NMOS) transistor.

* * * * *